US012221861B2

(12) United States Patent
Al-Mousa

(10) Patent No.: US 12,221,861 B2
(45) Date of Patent: Feb. 11, 2025

(54) GENERATING ELECTRICITY WITH A WELLBORE DRILLING MUD FLOW

(71) Applicant: Saudi Arabian Oil Company, Dhahran (SA)

(72) Inventor: Ahmed Abdullah Al-Mousa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 65 days.

(21) Appl. No.: 17/974,248

(22) Filed: Oct. 26, 2022

(65) Prior Publication Data

US 2024/0141758 A1 May 2, 2024

(51) Int. Cl.
*E21B 41/00* (2006.01)
*E21B 21/08* (2006.01)

(52) U.S. Cl.
CPC ..... *E21B 41/0085* (2013.01); *E21B 21/08* (2013.01)

(58) Field of Classification Search
CPC ..... E21B 41/0085; E21B 21/08
See application file for complete search history.

(56) References Cited

U.S. PATENT DOCUMENTS

| | | | | |
|---|---|---|---|---|
| 7,165,608 | B2 | 1/2007 | Schultz et al. | |
| 7,997,870 | B2 | 8/2011 | Neumann | |
| 8,890,341 | B2 | 11/2014 | Ocalan et al. | |
| 10,044,244 | B2 | 8/2018 | Downing | |
| 10,167,702 | B2 | 1/2019 | Delgado | |
| 2009/0288840 | A1* | 11/2009 | Eriksen | E21B 21/106 166/377 |
| 2017/0131429 | A1* | 5/2017 | Schneider | G01V 5/101 |
| 2018/0179880 | A1* | 6/2018 | Sankaran | E21B 44/00 |
| 2021/0277748 | A1 | 9/2021 | Rajagopalan et al. | |
| 2021/0277749 | A1* | 9/2021 | Alhuraifi | E21B 41/00 |
| 2022/0316454 | A1* | 10/2022 | Bodishbaugh | E21B 21/06 |

* cited by examiner

*Primary Examiner* — Caroline N Butcher
(74) *Attorney, Agent, or Firm* — Fish & Richardson P.C.

(57) ABSTRACT

A well system and a method for generating electricity with a wellbore drilling mud flow in a well system. The well system has a drilling rig positioned above a wellbore and a flow line turbine generator coupled to the drilling rig. The drilling rig has a wellhead assembly coupled to the wellbore, a drill string suspended from the drilling rig and extending through the wellhead assembly into the wellbore, a mud tank, and a mud pump fluidly coupled to the mud tank. The mud pump flows a drilling mud from the mud tank into the drill string. The flow line turbine generator is positioned between the wellhead assembly and the mud tank. The flow line turbine generator generates electricity using a return flow of the drilling mud from the wellbore through the wellhead assembly to the mud tank.

28 Claims, 4 Drawing Sheets

GENERATING ELECTRICITY WITH A WELLBORE DRILLING MUD FLOW

TECHNICAL FIELD

This disclosure relates to generating electricity, in particular, during a wellbore operation.

BACKGROUND

Drilling rigs drill wellbores in the Earth with a drill bit attached to a bottom end of a drill string. Drilling mud flows from a mud tank down the inside of the drill string, out the drill bit, back up an annulus of the wellbore, out of the wellbore, and through a drilling mud return conduit connecting the annulus back to the mud tank.

SUMMARY

This disclosure describes systems and methods related to generating electricity with a drilling mud return flow. This approach generates electricity with a well system having a drilling rig and a flowline turbine generator coupled to the drilling rig. The flow line turbine generator is fluidly operated by the drilling mud return flow. The drilling rig has a wellhead assembly coupled to a wellbore, a drill string suspended from the drilling rig and extending through the wellhead assembly into the wellbore, a mud tank, and a mud pump fluidly coupled to the mud tank. The flow line turbine generator is positioned between the wellhead assembly and the mud tank. The flow line turbine generator generates electricity using a return flow of the drilling mud. The return flow is from the wellbore through the wellhead assembly and to the mud tank.

In one aspect, a well system includes a drilling rig and a flow line turbine generator coupled to the drilling rig. The drilling rig is positioned above a wellbore. The drilling rig has a wellhead assembly coupled to the wellbore, a drill string suspended from the drilling rig and extending through the wellhead assembly into the wellbore, a mud tank, and a mud pump fluidly coupled to the mud tank. The mud pump flows a drilling mud from the mud tank into the drill string. The flow line turbine generator is positioned between the wellhead assembly and the mud tank. The flow line turbine generator generates electricity using a return flow of the drilling mud from the wellbore through the wellhead assembly to the mud tank.

In some implementations, the flow line turbine generator includes a generator coupled to a shaft which rotates responsive to the return flow. In some cases, a seal is positioned about the shaft.

In some implementations, the flow line turbine generator has of blades coupled to the shaft. The blades allow wellbore cuttings in the return flow to pass through the flow line turbine generator. In some cases, a spacing between each of the blades allows the wellbore cuttings in the return flow to pass through the flow line turbine generator.

In some cases, the well system includes a turbine defined by a tube to conduct the return flow. The blades and the shaft are positioned in the tube. The well system also includes a data and power cable coupled to the turbine. In some cases, a computer is coupled to the data and power cable. The data and power cable communicates flow data from the turbine to the computer. The flow data can be a percent of fluid returned or a flow type.

In some cases, the well system includes an electrical storage device. The data and power cable flows the electricity from the generator to the electrical storage device. The electrical storage device can be a battery, a fuel cell, a capacitor, a super capacitor, or an inductor.

In some implementations, the wellhead assembly has a wellhead return annulus to conduct the return flow from a wellbore annulus to the flow line turbine generator.

In another aspect, electricity is generated with a well system having a wellbore. Electricity is generated by flowing a drilling mud through a drilling mud system of well system. Responsive to flowing the drilling mud through a flow line turbine generator positioned in a return flow of drilling mud system, electricity is generated.

In some implementations, the electricity generated by the flow of the drilling mud through the flow line turbine generator is stored in an electrical storage device. In some cases, the electricity stored in the electrical storage device is transmitted to a rig tool.

In some implementations, generating electricity includes, responsive to flowing the drilling mud through a flow line turbine generator, rotating turbine blades positioned in a tube of the flow line turbine generator about a shaft.

In some implementations, the drilling mud has wellbore cuttings.

In some implementations, the flow line turbine generator has a data and power cable and flow data from the flow line turbine generator is transmitted to a computer.

In some implementations, while flowing the drilling mud, a drill string is rotated and a length of the wellbore is drilled. In some cases, flowing the drilling mud through the drilling mud system includes moving the drilling mud from a mud tank, increasing a pressure of the drilling mud, flowing the drilling mud into the drill string, flowing the drilling mud from the drill string through the wellbore entraining wellbore cuttings in the drilling mud, and flowing the drilling mud from the wellbore through a wellhead assembly to the flow line turbine generator.

In some implementations, flowing the drilling mud through a drilling mud system includes flowing the drilling mud at 300 gallons per minute.

In some implementations, generating electricity includes generating between 800 and 1200 kW of electricity.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
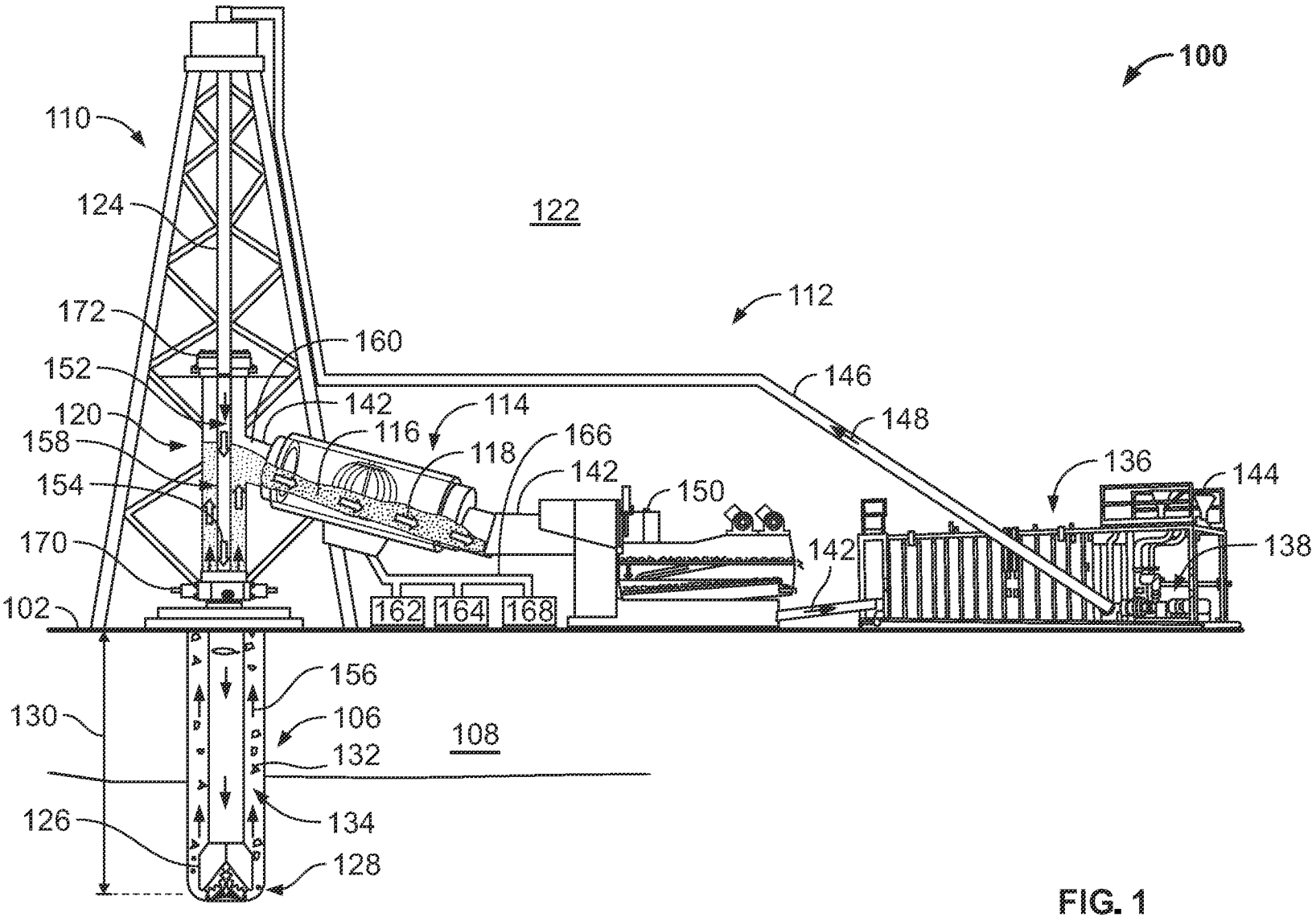
FIG. 1 is a schematic view of a drilling rig with a drilling mud powered flow line turbine generator.

The present disclosure relates to generating electricity with a flow line turbine generator. This approach generates electricity by a return flow of drilling mud through the flow line turbine generator. A well system includes a drilling rig positioned above a wellbore and the flow line turbine generator coupled to the drilling rig. The drilling rig has a wellhead assembly, a drill string, a mud tank, and a mud pump. The wellhead assembly is coupled to the wellbore.

The drill string is suspended from the drilling rig and extends through the wellhead assembly into the wellbore. The mud tank contains drilling mud. The mud pump flows the drilling mud from the mud tank into the drill string. The flow line turbine generator is positioned between the wellhead assembly and the mud tank. As a return flow of the drilling mud from the wellbore through the wellhead assembly to the mud tank flows through the flow line turbine generator, electricity is generated.

When drilling a wellbore with a drilling rig, electricity can be generated. Electricity on a drilling rig can be used to power equipment. For example, electricity can be used to power lights, computers, communications equipment, personnel safety equipment such as detectors of poisonous gas ($H_2S$), and wellbore monitoring and control equipment, as well as drilling, logging, completion, and production tools. In some cases, electricity can be supplied to the drilling rig by a commercial electric grid. The commercial electric grid may not reach some drilling locations. For example, the drilling rig location can be in a remote location or offshore in the ocean. In some cases, electricity can be supplied to the drilling rig by an electrical generator powered by a motor, such as a diesel engine or gasoline engine. Sometimes, the electrical generator or motor can fail mechanically or the fuel supply can be interrupted. In some cases, the fuel supply to the motor can be reduced. Some electricity can be generated by flowing the drilling mud returning from the wellbore through a flow line turbine generator.

Implementations of the present disclosure can realize one or more of the following advantages. These systems and methods can increase rig electrical power production. For example, the drilling rig can receive power from an electrical generator powered by an engine, such as a diesel engine or a gasoline engine. The flow line turbine generator can generate additional electrical power relative to the electrical generator powered by the engine alone.

These systems and methods can reduce impacts to the environment. For example, less fuel in the form of diesel and gasoline may be used to generate a given quantity of electricity on the drilling rig. For example, reducing fuel used can reduce harmful carbon emissions into an atmosphere of the Earth.

These systems and methods can improve personnel and environmental safety. For example, the electrical storage device can provide an emergency source of electrical power for the drilling rig in the event the engine or electrical generator fails, becomes inoperative, or a fuel supply is interrupted. This electric storage device can be used to power rig personnel life support equipment, rig lighting, wellbore safety monitoring equipment, and wellbore control equipment in an emergency.

FIG. 1 is a schematic view of a drilling rig with a drilling mud powered flow line turbine generator. Referring to FIG. 1, the well system 100 includes a wellbore 106 which extends from a surface 102 of the Earth to control the flow of fluids in the form of liquids and gases such as water and hydrocarbons from sub surface geologic formations 108 to the surface 102 for production, refining, and industrial utilization. The well system 100 includes a drilling rig 110 positioned on the surface 102 of the Earth and extending in an upwards direction from the surface 102 of the Earth. The drilling rig 110 is positioned above the wellbore 106. The drilling rig 110 incudes a drilling mud system 112.

A flow line turbine generator 114 is positioned in the drilling mud system 112 to generate electricity responsive to a return flow 116 (shown in the direction of arrows 118) of the drilling mud from the wellbore 106. The flow line turbine generator 114 is described in detail in reference to FIGS. 2A-2C.

The well system 100 has a wellhead assembly 120 coupled to the wellbore 106. The wellhead assembly 120 seals the wellbore 106 from the surrounding environment 122 and seals around components entering and exiting the wellbore 106. Also, the wellhead assembly 120 controls the flow of fluids and into and out of the wellbore 106.

The drilling rig 110 has a drill string 124 suspended from the drilling rig 110. The drill string 124 includes a drill bit 126 coupled to a downhole end 128 of the drill string 124. The drill string 124 rotates to drill (extend) a length 130 of the wellbore 106 by removing the sub surface geologic formations 108. Drilling to extend the length 130 of the wellbore 106 produces wellbore cuttings 132 from the removed sub surface geologic formations 108. The wellbore cuttings 132 are suspended in the drilling mud in a wellbore annulus 134 defined by the wellbore 106 and the drill string 124.

The drilling mud system 112 includes a mud tank 136, a mud pump 138, a supply conduit 146, and return conduit 142 to control the flow of the drilling mud in the well system 100. The mud tank 136 is the source of and holds the drilling mud. The mud tank 136 can include funnels 144 in which an operator can add chemicals and additives to the drilling mud. The drilling mud in the mud tank 136 is clean. That is, the drilling mud in the mud tank does not contain the wellbore cuttings 132.

The mud pump 138 is fluidly coupled to the mud tank 136. The mud pump 138 draws the drilling mud from the mud tank 136 and pressurizes the drilling mud. The mud pump 138 flows the drilling mud from the mud tank 136 into the drill string 124 through the supply conduit 146 in the direction of arrow 148. The mud pump 138 can include one or more mud pumps. In some cases, the mud pump 138 can pump the drilling mud between 100 and 1200 gallons per minute. In some cases, the mud pump 138 flows the drilling mud through the flow line turbine generator 114 at 300 gallons per minute. The maximum flow rate is related to the flow coming from the wellbore 106. The higher pump flow rate coming from rig pump 138, the higher the flow rate coming from the wellbore 106 and entering the return conduit 142, thus more power is generated by the flow line turbine generator 114.

The return conduit 142 is coupled between the wellhead assembly 120 and the mud tank 136. The return conduit 142 conducts the flow of the drilling mud from the wellhead assembly 120 to the mud tank 136.

In some implementations, the drilling mud system 112 includes a shale shaker 150 positioned in the return conduit 142. The shale shaker 150 removes the wellbore cuttings 132 from the drilling mud.

In operation, the drilling mud flows through the drilling mud system 112. The drilling mud is drawn from the mud tank 136 by a suction force from the mud pump 138. The mud pump 138 pressurizes the drilling mud and flows the drilling mud through the supply conduit 146 in the direction of arrow 148 into the drill string 124. The drill string 124 is extended through the wellhead assembly 120 and positioned in the wellbore 106. The drilling mud flows through a bore 152 of the drill string in the direction of arrow 154. The drilling fluid exits the bore 152 of the drill string 124 through the drill bit 126 at the downhole end 128 and the wellbore cuttings 132 are entrained in the drilling mud. The drilling mud moves from the downhole end 128 through the wellbore annulus 134 in the direction of arrows 156 to the wellhead assembly 120. The drilling mud with entrained wellbore cuttings 132 enter a wellhead annulus 158 defined by the wellhead assembly 120 and the drill string 124. The drilling mud with the entrained wellbore cuttings 132 exit the wellhead assembly through an outlet 160 and flow into the return conduit 142. The drilling mud with the entrained wellbore cuttings 132 flows through the return conduit 142 to the flow line turbine generator 114. The drilling mud with the entrained wellbore cuttings 132 flows through the flow line turbine generator 114 in the direction of arrows 118, generating electricity.

The drilling mud with the entrained wellbore cuttings 132 exits the flow line turbine generator 114 and continues through the return conduit 142 to the shale shaker 150. The shale shaker 150 removes the wellbore cuttings 132 from the drilling mud. The clean drilling mud continues to flow from the shale shaker 150 back through the return conduit 142 and into the mud tank 136.

In some implementations, the well system 100 can include multiple flow line turbine generators 114. For example, the well system 100 can include two, three, seven, or more flow line turbine generators 114 coupled to the return conduit 114. The multiple flow line turbine generators 114 can be positioned in series, parallel, or combinations of series and parallel to generate electricity.

In some cases, the wellhead assembly 120 can include a blowout preventer 170 coupled to the wellbore 106 at the surface 102 of the Earth. The blowout preventer 170 seals the wellbore 106 from the surrounding environment 122 in an emergency. The wellhead assembly 120 can include a rotating control device 172 to seal the wellhead annulus 158 from the surrounding environment 122 during normal drilling rig 110 operation.

Figure 2A:
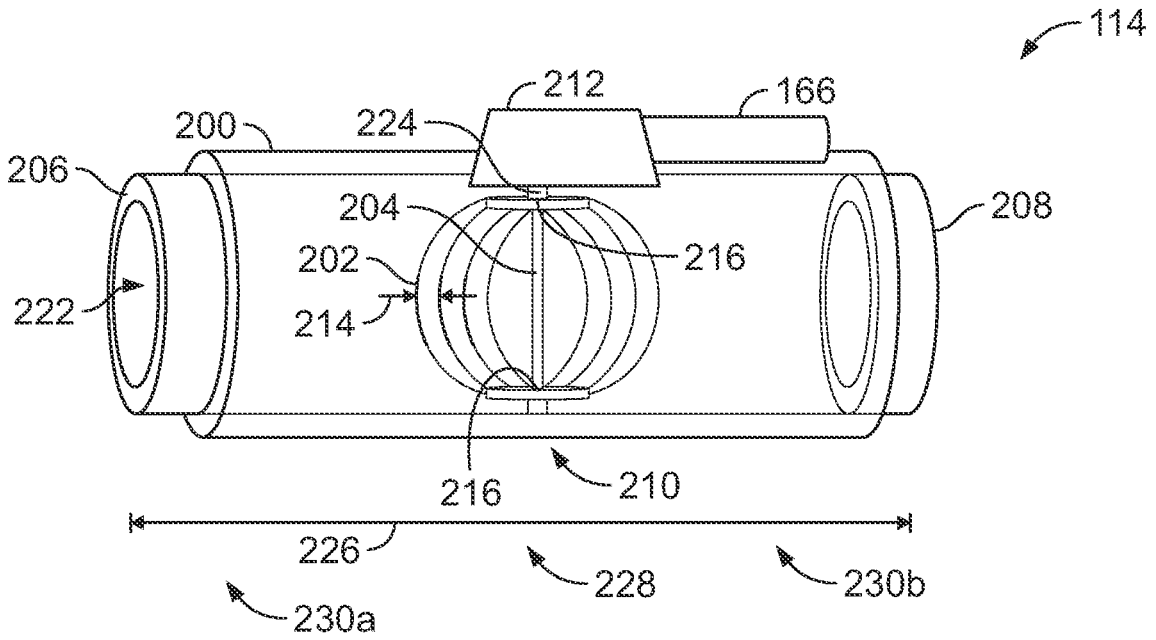
FIGS. 2A-2C are schematic views of the flow line turbine generator of FIG. 1.
Figure 2B:
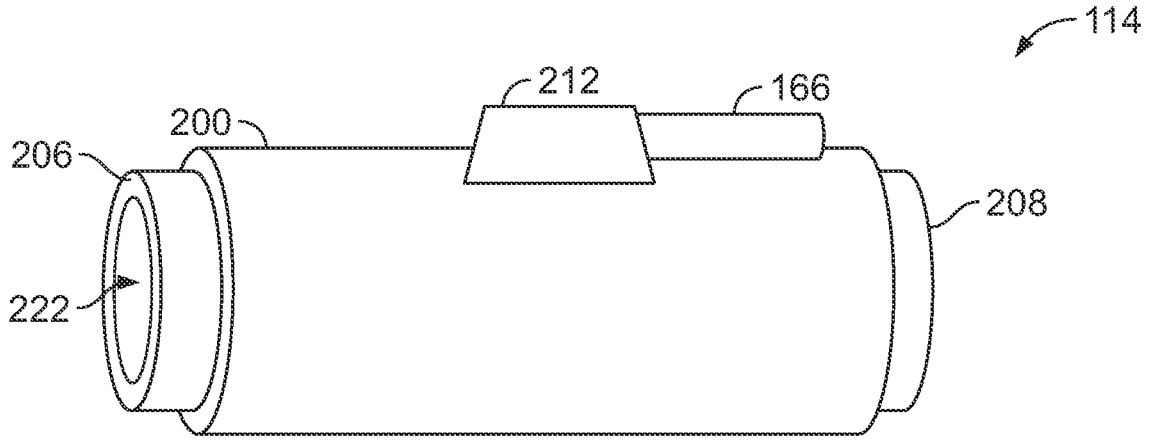
Figure 2C:
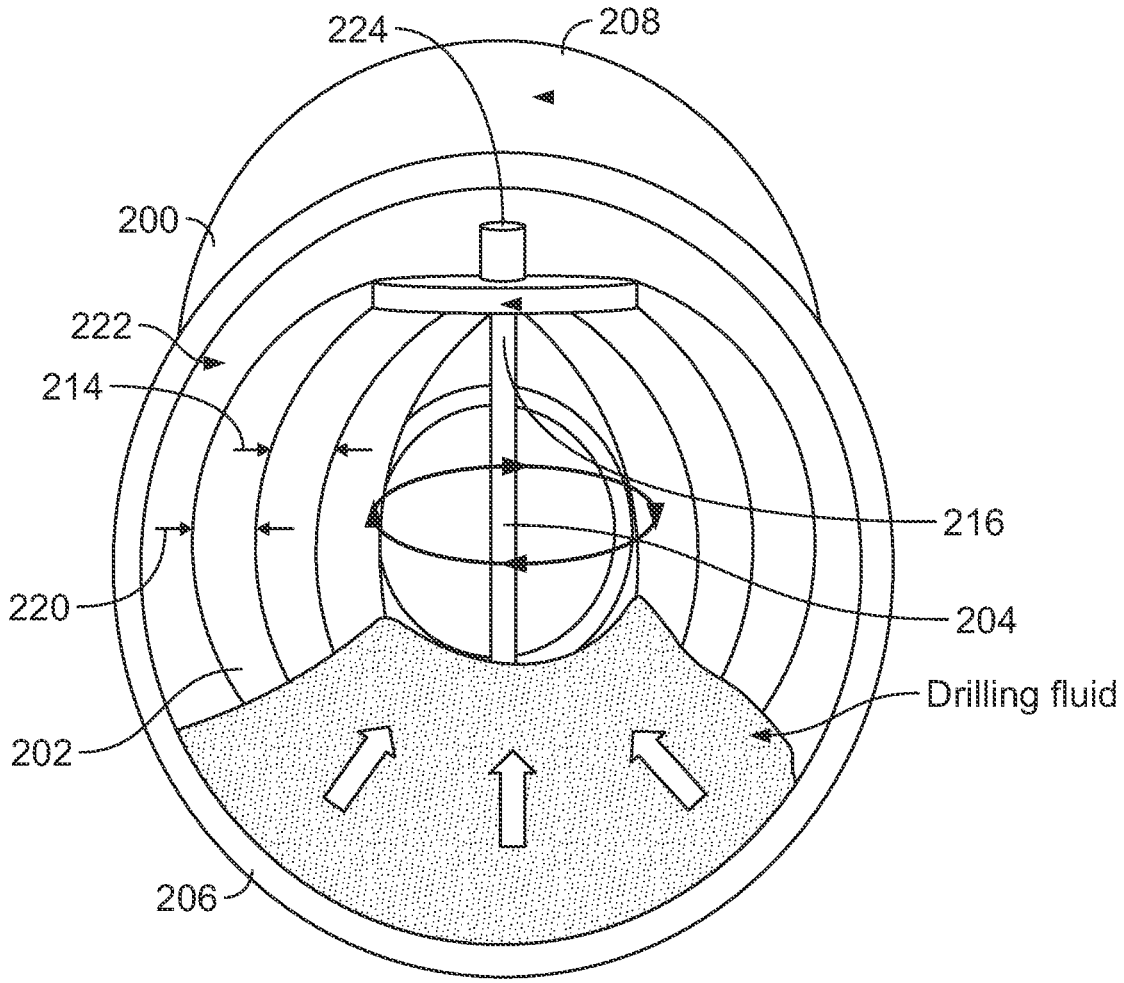

FIGS. 2A-2C are schematic views of the flow line turbine generator of FIG. 1. Referring to FIGS. 1-2C, the flow line turbine generator 114 has a tube 200 and blades 202 coupled to a shaft 204 positioned in the tube 200. The blades 202 rotate about the shaft 204 responsive to the drilling mud impinging upon the blades 202 to generate electricity. The tube 200, the shaft 204, and the blades 202 define a turbine 210 of the flow line turbine generator 114. The flow line turbine generator 114 includes a generator 212 coupled to the shaft 204 of the turbine 210. The shaft 204 and the blades 202 are a rotatable assembly.

The shaft 204 extends across an inner volume 222 defined by the tube 200. The shaft 204 is positioned along a length 226 of the tube 200. For example, the shaft 204 can be placed along the length 226 of the tube 200 at a mid-point 228, or near the ends 230*a,b*. As shown in FIGS. 1-2C, the shaft 204 is oriented vertically (in other words, generally perpendicular) relative to the surface 102 of the Earth. However, in some cases, the shaft 204 can be oriented horizontally or angled relative to the surface 102 of the Earth. The shaft 204 can be solid or hollow. The shaft 204 can include sensors (not shown) to sense conditions of the flow line turbine generator 114 or the drilling mud.

The blades 202 are mechanically coupled to the shaft 204. The blades 202 rotate about the shaft 204 relative to the return flow of the drilling mud through the tube 200. The blades 202 are spaced apart by a distance 214. The distance 214 can vary from a first end 216 of the shaft 204 to a second end 218 of the shaft 204. For example, the distance 214 can be between 0.01 inches and 2 inches, or in some cases, more than 2 inches. The distance 214 can depend on the required rated power needed from the flow line turbine generator 114. For example, in some cases, a smaller distance 214 (i.e., less space) between blades 202 of the same size results in more blades 202 coupled to the shaft 204, and more blades 202 available for increased power generated be the flow line turbine generator 114.

Referring to FIG. 2C, the blades 202 have a width 220. The width 220 can vary from the first end 216 of the shaft 204 to the second end 218 of the shaft 204. For example, the width 220 can be between 0.1 inches and 2 inches, or in some cases, more than 2 inches. For example, in some cases, a smaller width 220 (i.e., less space) between blades 202 of the same size results in more blades 202 coupled to the shaft 204, and more blades 202 available for increased power generated be the flow line turbine generator 114. The distance 214 between the blades 202 and the width 220 of the blades allows the wellbore cuttings 132 entrained in the drilling mud to pass through the flow line turbine generator 114. In other words, the wellbore cuttings 132 do not clog the blades 202.

In some implementations, the flow line turbine generator 114 includes multiple shafts 204 with blades 202 mechanically coupled to the shafts 204 driving multiple generators 212 to generate electricity responsive to the return mud flow. For example, the flow line turbine generator 114 can include two, three, four, five, or more shaft 204, blade 202, and generator 212 combinations positioned along the length 226 of the tube 200. In some implementations, multiple sets of blades 202 can be positioned on a single shaft 204.

The generator 212 includes a rotor (not shown) coupled to the shaft 204 and a stator (not shown) positioned relative to the rotor. The shaft 204 rotates the rotor relative to the stator to generate electricity. The stator has wire coils. When the rotor moves relative to the stator an electrical current is generated which flows through the data and power cable 166 and is stored in the electrical storage device 164 for use by the drilling rig 110. The wire coils can be made from metal. For example, the wire coils can be copper or any other conductive material. In some cases, the generator 212 generates between 800 and 1200 kW of electricity. By converting 800 and 1200 kW to +/−1100 Kva this will generate approximately +/−370 HP available for drilling rig 110 use.

The flow line turbine generator 114 includes a seal 224 surrounding the shaft 204 to prevent drilling mud from leaking into the generator 212. The seal 224 can be an elastomer or a metal.

The flow line turbine generator 114 can include various sensors (not shown) to monitor the conditions of the turbine 210 or the generator 212. For example, the sensors can include sensors and meters to measure amperage, voltage, a capacitance, and resistance of the stator, the data and power cable 166, or the electrical storage device 164. The computer 162 can include switches (not shown) to control the flow of from the flow line turbine generator 114 to the electrical storage device 164 and control the flow of electricity from the electrical storage device 164 to the rig tools 168.

The tube 200 has an upper connection 206 and a lower connection 208, corresponding to an inlet and outlet, respectively, of the tube 200. The tube 200 is positioned in the return conduit 142 (shown in FIG. 1). The drilling mud passes through the return conduit 142 from the wellhead assembly 120 through the upper connection 206, through the tube 200 and out the lower connection 208 into another section of the return conduit 142 to the shale shaker 150 and/or the mud tank 136. In some cases, as shown in FIG. 1, the tube 200 is angled relative to the surface 102 of the Earth. For example, when the flow line turbine generator 114 is installed in the return conduit 142, the upper connection 206 can be at a height greater than a height of the lower connection 208 relative to the surface 102 of the Earth. In some cases, the angle of the tube 200 relative to the surface 102 of the Earth allows gravity to aid or increase the flow of the drilling fluid and the entrained wellbore cuttings 132 to flow through the tube 200 and the blades 202. In some cases, increased flow can increase a quantity of electricity generated by the flow line turbine generator 114.

Referring to FIGS. 1-2C, the flow line turbine generator 114 includes a data and power cable 166 electrically coupled to the turbine 210, the generator 212, a computer 162 (shown in FIG. 1), and an electrical storage device 164 (shown in FIG. 1). The computer 162 can include one or more processors and a computer-readable medium storing computer instructions executable by the one or more processors to perform operations described here including operations to control the flow line turbine generator 114, the drilling rig 110, and the drilling mud system 112 described in this specification.

The data and power cable 166 transmits flow data (such as a percent fluid returned or a flow type of the drilling mud) from sensors (not shown, previously described) to the computer 162. The data and power cable 166 can transmit control signals from the computer 162 to the flow line turbine generator 114 and the electrical storage device 164. The data and power cable 166 can transmit the generated electricity from the generator 212 to the electrical storage device 164. The computer 162 can control the flow of electricity from the electrical storage device 164 to a rig tool 168 for use on the drilling rig 110.

In some cases, the electrical storage device is a battery, a fuel cell, a capacitor, a super capacitor, or an inductor. In some cases, the rig tool 168 is a safety device, a sensor, a light, or drilling or completion equipment.

Figure 3:
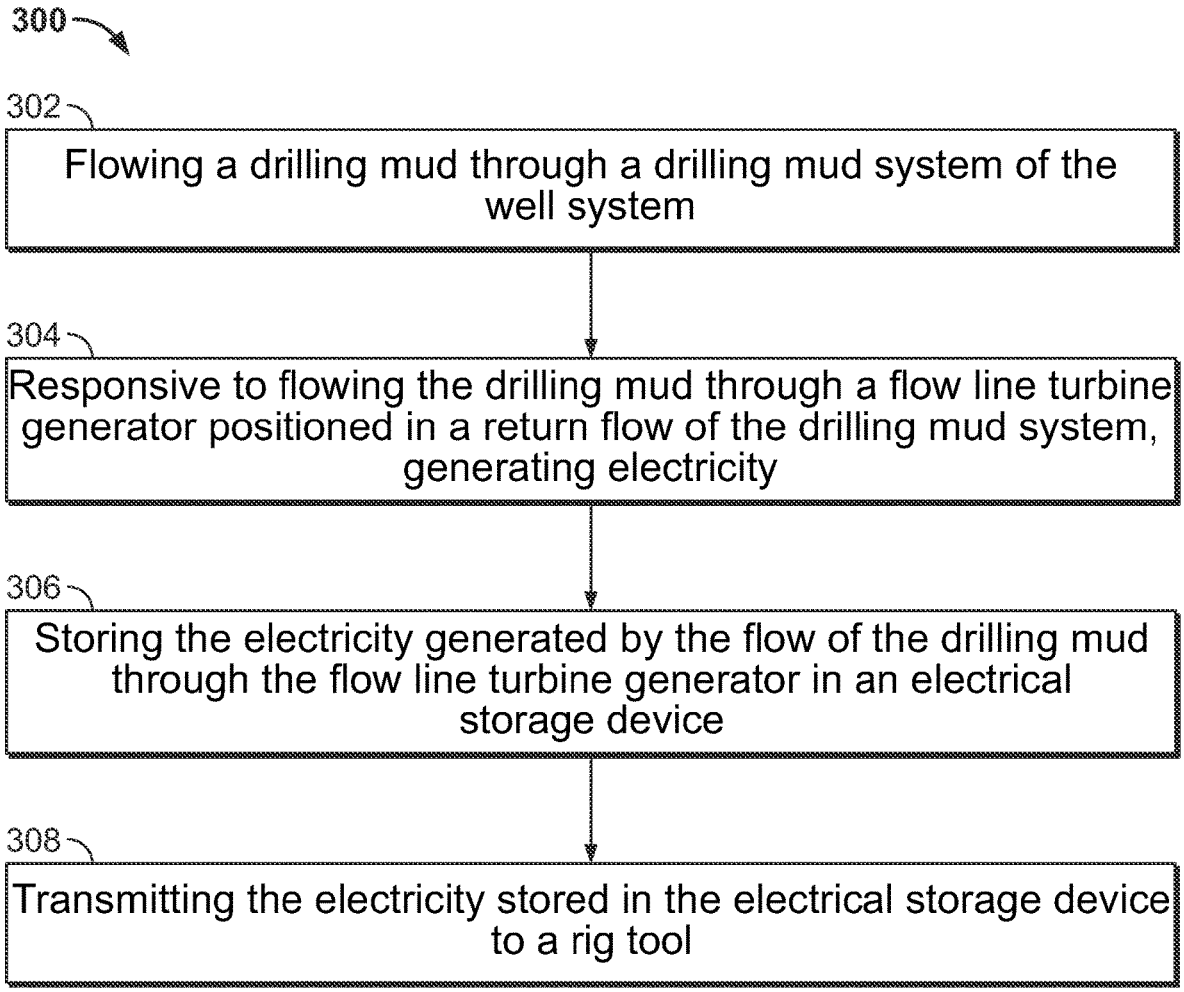
FIG. 3 is a flow chart of an example method of generating electricity with a flow line turbine generator.

FIG. 3 is a flow chart 300 of an example method of generating electricity with a well system according to the implementations of the present disclosure. At 302, in a well system having a wellbore, a drilling mud is flowed through a drilling mud system of the well system. For example, the drilling mud can be flowed through the wellbore 106 and the drilling mud system 112.

In some implementation, while flowing the drilling mud, a drill string is rotated and a length of the wellbore is drilled. For example, the drill string 124 can be rotated by the drilling rig 110 when the drill bit 126 is at the downhole end 128 to extend the length 130 of the wellbore 106.

For example, In some implementations, the drilling mud includes wellbore cuttings. For example, when the drill bit 126 removes the sub-surface geologic formations 108, wellbore cuttings 132 are produced.

In some implementations, flowing the drilling mud through the drilling mud system includes moving the drilling mud from a mud tank and increasing a pressure of the drilling mud to flow the drilling mud into the drill string. Flowing the drilling mud through the drilling mud system includes flowing the drilling mud from the drill string through the wellbore entraining wellbore cuttings in the drilling mud. Flowing the drilling mud through the drilling mud system includes flowing the drilling mud with the entrained wellbore cuttings from the wellbore through a wellhead assembly to the flow line turbine generator. For example, the drilling mud can be drawn from the mud tank 136 by the suction force from the mud pump 138. The mud pump 138 pressurizes the drilling mud and flows the drilling mud through the supply conduit 146 in the direction of arrow 148 into the drill string 124. The drill string 124 is extended through the wellhead assembly 120 and positioned in the wellbore 106. The drilling mud flows through the bore 152 of the drill string in the direction of arrow 154. The drilling fluid exits the bore 152 of the drill string 124 through the drill bit 126 at the downhole end 128 and the wellbore cuttings 132 are entrained in the drilling mud. The drilling mud moves from the downhole end 128 through the wellbore annulus 134 in the direction of arrows 156 to the wellhead assembly 120. The drilling mud with entrained wellbore cuttings 132 enter the wellhead annulus 158. The drilling mud with the entrained wellbore cuttings 132 exit the wellhead assembly through an outlet 160 and flow into the return conduit 142. The drilling mud with the entrained wellbore cuttings 132 flows through the return conduit 142 to the flow line turbine generator 114.

In some cases, flowing the drilling mud through a drilling mud system includes flowing the drilling mud at 300 gallons per minute. For example, the mud pump 138 can flow the drilling mud at 300 gallons per minute.

At 304, responsive to flowing the drilling mud through a flow line turbine generator positioned in the drilling mud system, electricity is generated. For example, the flow line turbine generator 114 positioned in the return conduit 142 of the drilling mud system 112 generates electricity responsive to the return flow 116 of the drilling mud.

In some implementations, generating electricity includes, responsive to flowing the drilling mud through a flow line turbine generator, rotating turbine blades positioned in a tube of the flow line turbine generator about a shaft. For example, the drilling mud flowing through the flow line turbine generator 114 contacts the turbine blades 202 which then rotate about the shaft 204.

In some implementations, generating electricity includes generating between 800 and 1200 kW of electricity. For example, the generator 212 can generate between 800 and 1200 kW of electricity when the shaft 204 turns the rotor in the stator.

At 306, the electricity generated by the flow of the drilling mud through the flow line turbine generator is stored in an electrical storage device. For example, the electricity can be stored in the electrical storage device 164.

At 308, the electricity stored in the electrical storage device is transmitted to a rig tool. For example, the electricity store in the electrical storage device 164 can be transmitted to the rig tool 168 to power the rig tool 168.

In some implementations, the well system includes a data and power cable electrically connecting the flow line turbine generator to a computer. Generating electricity with the well system further includes transmitting flow data from the flow line turbine generator through the data and power cable to the computer. For example, the flow return percentages and flow type can be transmitted from the turbine 210 or the generator 212 to the computer 162.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A well system comprising:

a drilling rig positioned above a wellbore, the drilling rig comprising:

a wellhead assembly coupled to the wellbore;

a drill string suspended from the drilling rig and extending through the wellhead assembly into the wellbore;

a mud tank; and a mud pump fluidly coupled to the mud tank and configured to flow a drilling mud from the mud tank into the drill string; and a flow line turbine generator positioned between the wellhead assembly and the mud tank, the flow line turbine generator configured to generate electricity using a return flow of the drilling mud from the wellbore through the wellhead assembly to the mud tank, the flow line turbine generator comprising:

a generator; and a shaft coupled to the generator, wherein the shaft is oriented vertically in the flow line turbine generator relative to a surface of the Earth.

2. The well system of claim 1, wherein the shaft is configured to rotate responsive to the return flow.

3. The well system of claim 2, further comprising a seal positioned about the shaft.

4. The well system of claim 1, wherein the flow line turbine generator further comprises a plurality of blades coupled to the shaft, the plurality of blades configured to allow a plurality of wellbore cuttings in the return flow to pass through the flow line turbine generator.

5. The well system of claim 4, wherein a spacing between each of the plurality of blades allows the plurality of wellbore cuttings in the return flow to pass through the flow line turbine generator.

6. The well system of claim 4, further comprising:

a turbine defined by:

a tube to conduct the return flow; and the plurality of blades and the shaft positioned in the tube; and a data and power cable coupled to the turbine.

7. The well system of claim 6, further comprising an electrical storage device, wherein the data and power cable is further configured to flow the electricity from the generator to the electrical storage device.

8. The well system of claim 7, wherein the electrical storage device comprises at least one of a battery, a fuel cell, a capacitor, a super capacitor, or an inductor.

9. The well system of claim 6, wherein the shaft extends across an inner volume defined by the tube.

10. The well system of claim 9, wherein the shaft is oriented vertically in the tube relative to the surface of the Earth.

11. The well system of claim 6, further comprising a shale shaker, the shale shaker positioned between the flow line turbine generator and the mud tank.

12. The well system of claim 11, wherein the tube comprises an upper connection and a lower connection, the upper connection coupled to the wellhead assembly and the lower connection coupled to shale shaker.

13. The well system of claim 12, wherein the tube is further configured to flow the drilling mud from the upper connection to the lower connection only contacting the blades and the shaft.

14. The well system of claim 12, wherein the upper connection is positioned at a height greater than a height of the lower connection relative to the surface of the Earth.

15. The well system of claim 6, further comprising a computer coupled to the data and power cable, wherein the data and power cable is further configured to communicate flow data from the turbine to the computer.

16. The well system of claim 15, wherein the flow data comprises a percent of fluid returned or a flow type.

17. The well system of claim 1, wherein the wellhead assembly comprises a wellhead return annulus configured to conduct the return flow from a wellbore annulus to the flow line turbine generator.

18. A method for generating electricity with a well system comprising a wellbore, the method comprising:

flowing a drilling mud through a drilling mud system of the well system;

flowing the drilling mud through a flow line turbine generator positioned between a wellhead assembly and a shale shaker of the well system from an upper connection of the flow line turbine generator coupled to the wellhead assembly to a lower connection of the flow line turbine generator coupled to the shale shaker, the upper connection positioned at a height greater than a height of the lower connection relative to a surface of the Earth; and responsive to flowing the drilling mud through the flow line turbine generator from the upper connection to the lower connection, the flow line turbine generator positioned in a return flow of drilling mud system, generating electricity.

19. The method of claim 18, further comprising storing the electricity generated by the drilling mud flowing through the flow line turbine generator in an electrical storage device.

20. The method of claim 19, further comprising transmitting the electricity stored in the electrical storage device to a rig tool.

21. The method of claim 18, wherein generating electricity comprises, responsive to flowing the drilling mud through the flow line turbine generator, rotating a plurality of turbine blades positioned in a tube of the flow line turbine generator about a shaft.

22. The method of claim 18, wherein the drilling mud comprises a plurality of wellbore cuttings.

23. The method of claim 18, wherein the flow line turbine generator further comprises a data and power cable, the method further includes transmitting flow data from the flow line turbine generator to a computer.

24. The method of claim 18, further comprising:

while flowing the drilling mud, rotating a drill string; and drilling a length of the wellbore.

25. The method of claim 24, wherein flowing the drilling mud through the drilling mud system comprises:

moving the drilling mud from a mud tank;

increasing a pressure of the drilling mud;

flowing the drilling mud into the drill string;

flowing the drilling mud from the drill string through the wellbore entraining a plurality of wellbore cuttings in the drilling mud;

and flowing the drilling mud from the wellbore through the wellhead assembly to the flow line turbine generator.

26. The method of claim 18, wherein flowing the drilling mud through the drilling mud system comprises flowing the drilling mud at 300 gallons per minute.

27. The method of claim 18, wherein generating electricity comprises generating between 800 and 1200 kW of electricity.

28. A well system configured to couple to a wellbore, the well system comprising:

a flow line turbine generator configured to be positioned between a wellhead assembly configured to be coupled to the wellbore and a mud tank of a drilling mud system, the flow line turbine generator configured to generate electricity using a return flow of drilling mud from the wellbore through the wellhead assembly to the mud tank, the flow line turbine generator comprising:

a shaft; and a plurality of blades coupled to the shaft, wherein the each of the plurality of blades are further defined by a width, the width of each blade varying from a first end of the shaft to a second end of the shaft.

* * * * *